United States Patent [19]

Geier et al.

[11] 4,424,674

[45] Jan. 10, 1984

[54] DIE CASTING MACHINE

[76] Inventors: Roland Geier, Viale Europa 72A; Gerhard Zaiss, Via Ambra d'Oro 13, both of I25100 Brescia, Italy

[21] Appl. No.: 167,935

[22] Filed: Jul. 14, 1980

Related U.S. Application Data

[63] Continuation-in-part of Ser. No. 820,808, Aug. 1, 1977, abandoned.

[51] Int. Cl.[3] ..... B60T 17/22

[52] U.S. Cl. ..... 60/534; 60/560; 91/19; 91/24

[58] Field of Search ..... 60/534, 563, 593, 582, 60/560; 91/432, 24, 19, 410

[56] References Cited

U.S. PATENT DOCUMENTS

| | | | |
|---|---|---|---|
| 1,888,990 | 11/1932 | Kurath | 60/563 |
| 1,930,155 | 10/1933 | Wiedmann | 60/563 |
| 2,573,943 | 11/1951 | Ziskal | 91/432 |
| 3,293,849 | 12/1966 | Smith | 60/534 |
| 3,631,760 | 1/1972 | Moran | 92/134 |
| 3,891,126 | 6/1975 | Segawa | 92/134 |
| 3,985,063 | 10/1976 | Lemon | 92/60 |
| 4,149,384 | 4/1979 | Marshall | 60/593 |

*Primary Examiner*—Abraham Hershkovitz
*Attorney, Agent, or Firm*—Gifford, VanOphem, Sheridan & Sprinkle

[57] ABSTRACT

A pressure die casting machine having a working cylinder enclosing a working piston adjacent a multiplier cylinder having a multiplier piston slideably mounted therein. The working chamber intermediate the working piston and the multiplier piston is connected to a pressure medium supply line which includes a check valve. The check valve is separated from the pistons and is attached on the outside of the working cylinder and multiplier cylinder so that the pistons are not weakened and the valve is made accessible for maintenance. The supply of pressure medium to the pressure chamber is controlled by a valve arrangement actuable independently of the check valve.

10 Claims, 5 Drawing Figures

DIE CASTING MACHINE

This application is a contination-in-part of Ser. No. 820,808 filed Aug. 1, 1977, now abandoned.

The invention relates to a pressure die-casting machine. A working cylinder has a working piston and a multiplier cylinder connects to the working cylinder and has a multiplier piston. Enclosed between the working piston and multiplier pistons is a working chamber which is connected to a pressure medium supply line. This supply line can be shut off by means of a check valve and supplies a pressure medium which acts upon the working piston during a first and a second working phase of operation of the pressure die-casting machine. On that side of the multiplier piston remote from the working chamber is a pressure chamber into which a pressure medium can be introduced for driving the multiplier piston during a third working phase.

With conventional pressure die-casting machines of this general design, the check valve is arranged in the multiplier piston and closes automatically upon the rise of the pressure medium pressure in the working chamber toward the end of the second working phase so as to trigger the multiplier movement. This construction has the disadvantage that the check valve is accessible only with difficulty. Further, the multiplier piston is weakened by the pressure medium supply line which extends in it, a weakening which can be the cause of piston cracks. A further disadvantage lies in the fact that the transition from the second phase to the third working or pressing-in phase is not always free from pressure peaks. This is for the reason that, after the closure of the check valve, the mass of the multiplier piston has to be initially accelerated, before any rise in the pressure sets in in the third working phase.

While avoiding these above-described disadvantages, this invention envisions a pressure die-casting machine such that any weakening of the multiplier piston is avoided, the check valve is easily accessible, and the pressure rise at the beginning of the third working phase sets in as free from delay as possible and without encountering any pressure peaks.

In accordance with this invention, the pressure medium supply line extends outboard the multiplier piston, the check valve is arranged on a wall portion close to the working chamber of the working cylinder or multiplier cylinder, and the supply of the pressure medium to the pressure chamber of the multiplier cylinder is controllable by a valve arrangement which is actuatable independently of the check valve.

Herein, the check valve is separated from the multiplier piston and can be attached on the outside on the pressing-in part enclosing the working cylinder and multiplier cylinder. Thus any weakening of the multiplier piston is prevented. At the same time, the check valve is easily accessible for maintenance and repair measures. Generally, the check valve will be arranged as close as possible to the working chamber, so as to keep the paths for the pressure medium as short as possible.

The control of the multiplier piston being independent of the check valve, the multiplier piston can be set in motion prior to the closing of the check valve. The check valve is first closed first by the pressure rise, as caused by the multiplier piston, in the working chamber. Since, at this point in time, the multiplier piston is already in motion, there is effected, upon the transition from second to third working phase, a continuous pressure rise without any pressure peaks.

Preferentially, the valve arrangement comprises a volume control device, the cross-section of which for the passage of the pressure medium is preselectable, as well as a control valve which controls the volume control device and is actuatable in a pressure-dependent, time-dependent or path-dependent manner. Such a volume control device is for example described in my British Pat. No. 1,490,282, annexed hereto. In the volume control device, for example by a digital preselection at a control desk of the pressure die-casting machine, the cross-section of the passage is set so as to allow through passage of that amount of pressure medium is necessary for a specific speed of the multiplier piston. As a result of the control valve, this cross-section of passage is suddenly freed.

The multiplication pressure can be set in such a way that in the multiplier cylinder on the side of the multiplier piston remote from the pressure chamber, a prestressing chamber is connected to a pressure store by way of a line and further so that the charging pressure in the pressure store and the prestressing chamber is adjustable by way of a pressure control device. A suitable pressure control device for this purpose is described, for example, in British Pat. No. 1,469,676, annexed hereto.

Preferably arranged in the line between the prestressing chamber and pressure store is a controllable second check valve. In this way, it is possible to act upon the multiplier piston at the start of the second working phase with the pressure medium serving for its displacement and without the multiplier piston being moved.

Further preferentially, to control the second check valve, I use a way-valve which, as a function of its position, connects the prestressing chamber either to an atmosphere-loaded tank or to the pressure store associated with the prestressing chamber.

In many instances, it may be advantageous if the way-valve which serves to control the second check valve is actuatable without any time delay as a function of a control impulse which also causes the switching-in of the second working phase.

In order to prevent the pressure peaks which occur at the end of the second working or pressing-in phase after the filling of the die-casting mould and which arise as a result of a sudden deceleration of the moving masses, I connect an annular chamber, of the working cylinder, disposed on that side of the working piston which is remote from the working chamber, in the region of its end face far from the working piston, through a volume control device, to an atmosphere-loaded tank. In the case of the volume control device, it can be a question of a digitally-adjustable control device such as above mentioned.

Further features and advantages of the invention will emerge from the claims and description following which, in conjunction with the accompanying drawings, explains the invention with respect to the several exemplified embodiments.

Figure 1:
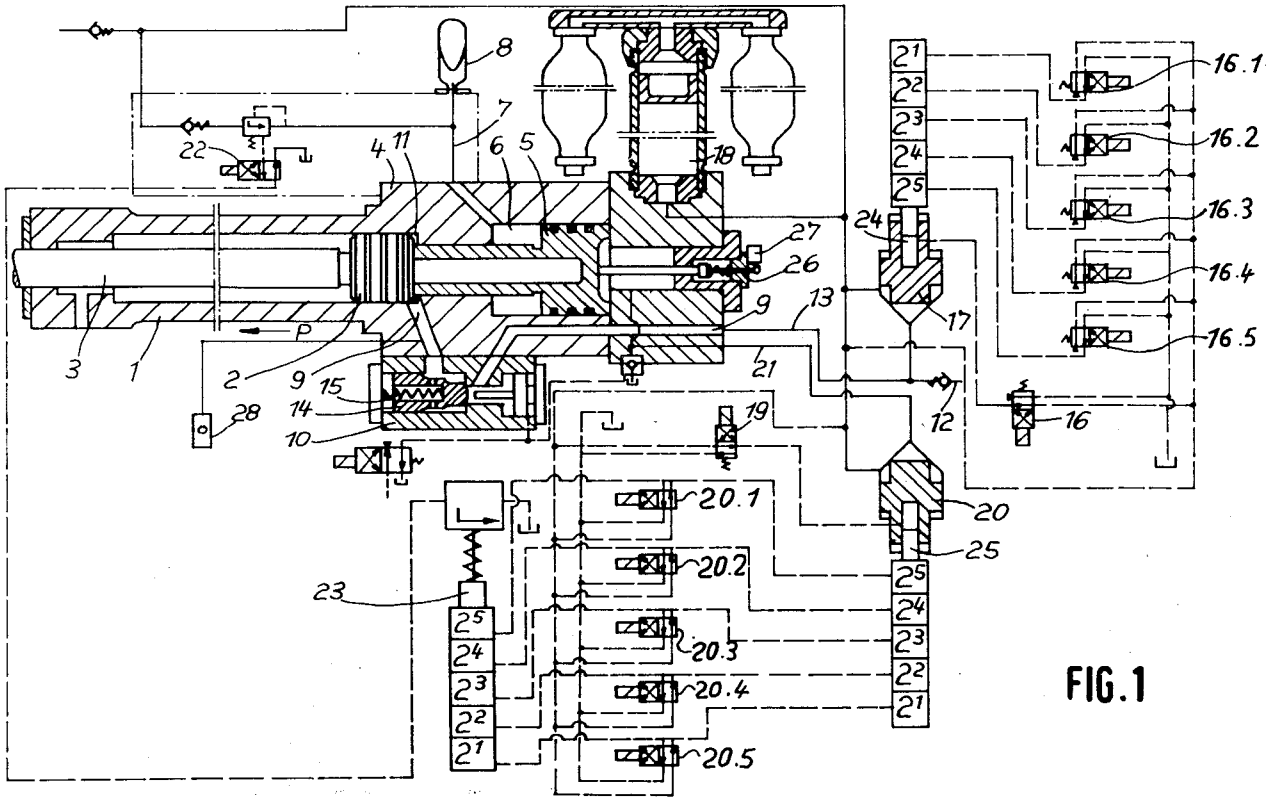
FIG. 1 is a schematic sectional representation of a pressing-in part of a three-phase cold-chamber pressure die-casting machine.

With reference to FIG. 1, a working cylinder 1 of a pressing-in part of a pressure die-casting machine is shown. Guided so as to be displaceable in working cylinder 1 is a working piston 2 connected to a piston rod 3. Connected securely to piston rod 3 is a press piston (not shown) which serves to press the casting material into a die-casting mould (also not shown). Piston rod 3 is surrounded by an annular chamber 31 which can be connected, by way of an opening 32 in working cylinder 1, to a tank (not shown) or a pressure-medium source (not shown), with the aid of which working piston 2 can be reset to its initial position.

Linking to working cylinder 1 is a multiplier cylinder 4, in which a multiplier piston 5 is displaceable. Multiplier piston 5 subdivides multiplier cylinder 4 into a prestressing chamber 6 and a pressure chamber 33, into which there is introduced the pressure medium essential for generating the multiplier pressure during the third working phase of the pressure die-casting machine.

Prestressing chamber 6 is connected by way of a line 7 to a bubble store 8. The end pressure, which can be produced by the multiplier, is fixed by the pressure prevailing in bubble store 8 and thus also in prestressing chamber 6. A further function of prestressing chamber 6 will be additionally explained later on with reference to the embodiment exemplified in FIG. 2.

Disposed on the side of working piston 2 which is remote from annular chamber 31 of working cylinder 1 is a working chamber 11, into which opens a pressure-medium supply line 9, the pressure medium is supplied through line 9 during the first and the second working phases of the pressure die-casting machine.

Incorporated into pressure-medium supply line 9 is a check valve 10, which is arranged on the outside of a pressing-in cylinder comprising working cylinder 1 and multiplier cylinder 4, close to working chamber 11.

The part of the pressure-medium supply line 9 lying upstream of check valve 10 is connected by way of a connection line 13, a further check valve 34 and a pump line 12 to a pump (not shown).

During the first working phase of the pressure die-casting machine, hydraulic medium is conveyed from the pump (not shown) by way of lines 12, 13 and 9 as well as check valve 10 to working chamber 11, whereby a closure piece 14 of check valve 10 is forced, against the pressure of a closing spring 15 of check valve 10, into the opening position. Consequently, working piston 2 is shifted in the direction of arrow P and forces, by way of a press piston (not shown), the casting material into the pressure die-casting mould. The speed of the forward motion of working piston 2 during the first working phase can be adjusted by a regulation of the amount of pressure medium conveyed by the pump.

After working piston 2 has covered a fixed path, a switch (not shown), which triggers a way-valve 16, is actuated by piston rod 3 or a member which is connected to it. Way-valve 16, for its part, controls a valve cone 17 of a volume control device 24, which regulates the flow of pressure medium from a piston store 18 by way of line portions 35, 36 and 37 to connection line 13. From there, the pressure medium passes in turn by way of line 9 and check valve 10 into working chamber 11 and acts on working piston 2. Since the pressure of the pressure medium coming out of piston store 18 is higher than the pressure of the pressure medium supplied by way of line 12, check valve 34 is automatically closed and in this second working phase of the pressure die-casting machine the filling of the mould is effected at a higher speed.

This speed is also determined by the amount of pressure medium supplied to working chamber 11 per unit of time, i.e. by the cross-section of the passage which is freed by volume control device 24. This cross-section of passage is fixed with the aid of a series of valves 16.1 to 16.5 preferentially magnetically-actuatable, the position of which is preselectable for example by means of an electrical selector switch (not shown) on a control panel (also not shown).

Corresponding to each way-valve 16.1 to 16.5 is a different cross-section of passage, in which respect preferably the respectively following valve frees twice as much pressure medium as the respectively preceding valve. In this way, as a result of an appropriate combination of the 5 valves 16.1 to 16.5 shown in FIG. 1, $2^5$ or 32 different cross-sections of passage can be set. This allows a corresponding variation of the amount of pressure medium supplied to working chamber 11 per unit of time, and thus of the speed of working piston 2.

Toward the end of the second working phase, when the pressure die-casting mould is substantially filled, the third working phase is triggered, in which, with the aid of multiplier piston 5, the casting material in the pressure die-casting mould is compacted. The triggering of the third working phase is effected by means of a way-valve 19 which is controlled in time-dependent, pressure-dependent or path-dependent manner.

Way-valve 19 belongs to a valve arrangement which includes a volume device 25 which controls the flow of pressure medium from piston store 18 by way of the partial lines 35, 36, 38 and a line 21 to pressure chamber 33.

Volume control device 25 is designed in the same way as volume control device 24. The cross-section of passage, which is freed by a valve cone 20 of volume control device 25, can be preselected by a suitable combination of magnetically-actuatable way-valves 20.1 to 20.5. Upon actuation of way-valve 19, then the cross-section of passage in accordance with the preselected valve combination is suddenly freed. The preselection of the desired combination of valves 20.1 to 20.5 can already be effected at the start of the second working phase.

As soon as, towards the end of the second working phase (i.e. upon achieving of the filling of the pressure die-casting mould), the pressure behind working piston 2 rises, the closing spring 15 forces closure piece 14 of check valve 10 onto the valve seat. The multiplication of the pressure by multiplier piston 5, already in motion, occurs in a delay-free manner without the occurrence of any pressure peaks.

Serving to set a desired final pressure of the multiplication is a pressure control device 23, by which the charging pressure in bubble store 8 and in prestressing chamber 6 is fixed. The pressure control device 23 can likewise be adjusted by valves 20.1 to 20.5 which serve as preliminary control valves, in which respect a suitable valve combination is preselected digitally at the control panel.

By the adjusting of way-valve 22, bubble store 8 and prestressing chamber 6 can be connected to pressure control device 23 to the end that the desired final pressure of the multiplication be fixed. The adjustment of way-valve 22 can, in this respect, in the same way as the displacement of valve 19 and 16, be effected by a programmable control.

The amount of pressure medium supplied from piston store 18 and thus the speed of pistons 2 and 5 during the second or third working phase is thus determined by the digital preselection of a suitable valve combination for the volume control devices 24 and 25 respectively, while the charging pressure for bubble store 8 and thus the final pressure resulting upon the multiplication is fixed by the preselection of a suitable valve combination for the digitally-adjustable pressure control device 23.

This description shows that, by way of volume control device 25, as may be required, a larger amount of pressure medium per unit of time can be called up for the third working phase than was the case with the second working phase, in which the supply of the pressure medium was effected by way of volume control device 24. Thus the advantage exists that a rapid pressure build-up during the third working phase can be achieved even in the case of a slow mould filling during the first and second working phases.

Arranged at that end of the multiplier cylinder which is remote from the working cylinder is a spring-loaded sensing pin 26 which acts, with its one end, on multiplier piston 5 in the initial position thereof and, at its other end, cooperates with a limit switch 27. In conjunction with this limit switch, it can be determined by sensing pin 26 as to when multiplier piston 5 leaves its initial position.

Furthermore, with the aid of a pressure absorber or receiver 28, upstream of working piston 2, upon each casting cycle, it is accurately ascertained as to whether and to what extent multiplier piston 5 has left its rest position, before the necessary pressure occurs in the working chamber. Thus the possibility is afforded of monitoring the use of the multiplier. Such a monitoring is vitally essential for successful pressure die-casting production. In the past it could be performed only at great expense.

Figure 2:
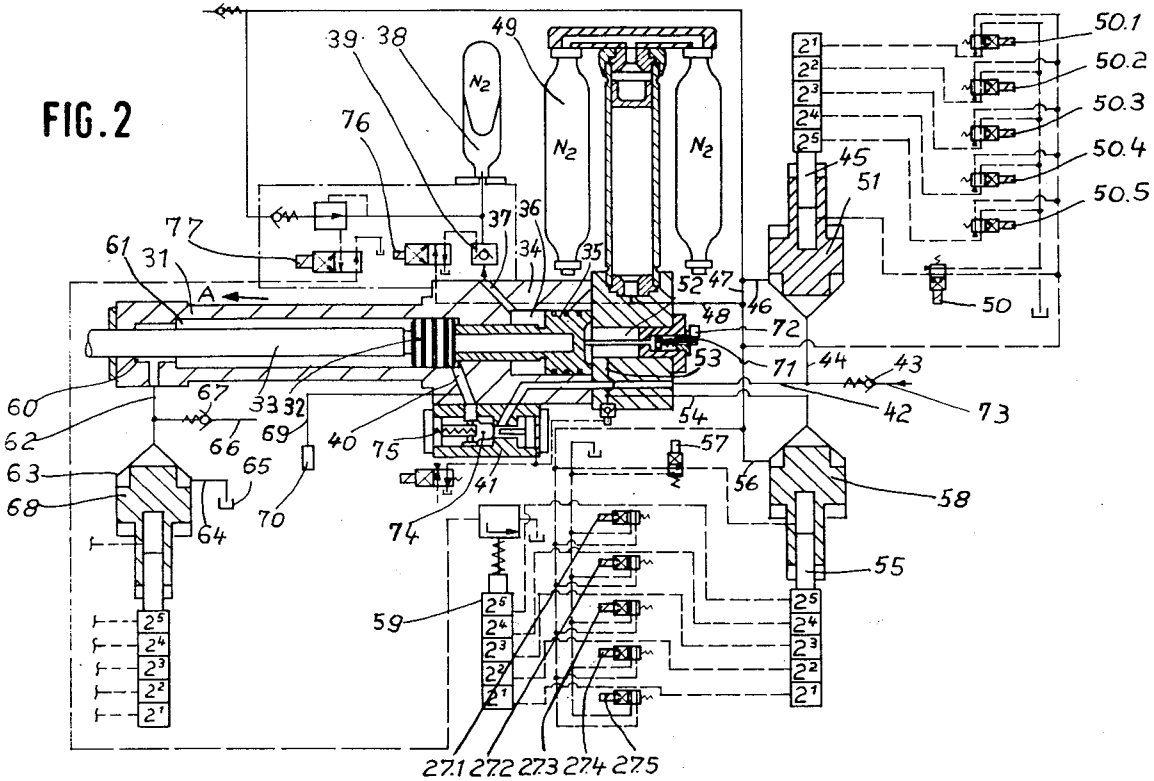
FIG. 2 is a similar representation of a second embodiment of the invention.

In the case of the press-in part, shown in FIG. 2, it is a question of a modified embodiment of the press-in part shown in FIG. 1. Identical parts in the two figures are provided with the same reference numerals.

In the FIG. 2 embodiment, opening 32 is connected by way of a line 39 and a digital volume control device 40 to a tank 41. Volume control device 40 is designed in the same way as volume control devices 24 and 25 and controls, by way of a valve cone 42, the cross-section of passage for the pressure medium flowing out of annular chamber 31 of working cylinder 1 to atmosphere-loaded tank 41. The opening path of the valve cone 42 can be set by an appropriate combination of preliminary control devices (not shown). The combination of the preliminary control valves can in turn be preselected by means of an electrical selector switch (not shown) on the control panel.

At the start of the second working phase, volume control device 40 opens valve cone 42 completely, so that the entire available cross-section of the passage is open. Consequently, the pressure medium displaced by forwardly-travelling working piston 2 can flow off unimpeded out of working cylinder 1. Toward the end of the second working phase, then, controlled in a time-dependent, path-dependent manner, the cross-section of the passage of volume control device 40 is reduced. In this way, the speed of the moving masses is dampened, so that the pressure peaks, which previously used to occur at the end of the mould filling, are largely eliminated.

Figure 3:
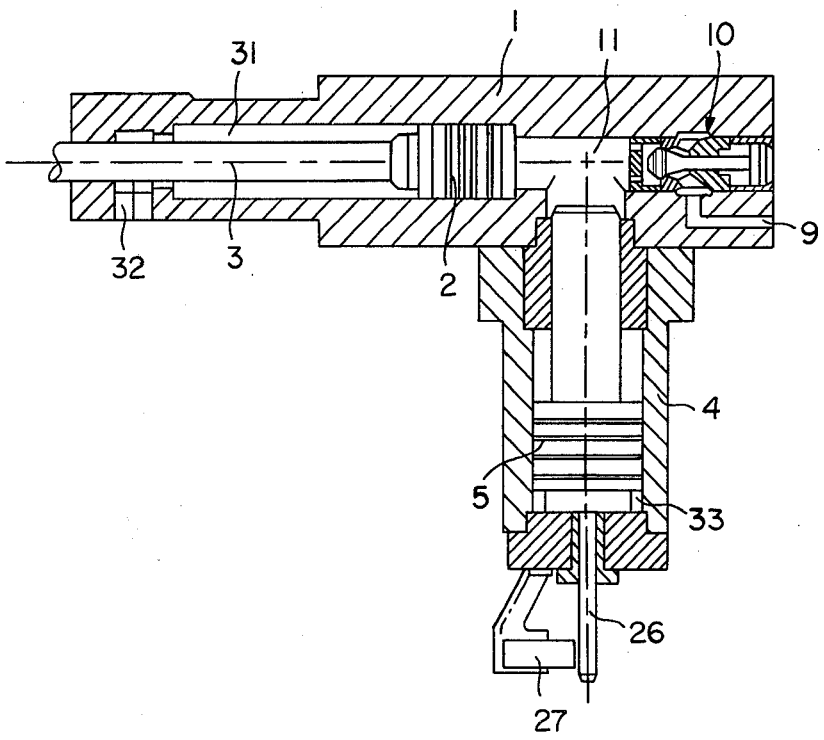
FIG. 3 is an axial sectional view through the working and multiplier cylinders of a third embodiment of the invention.
Figure 4:
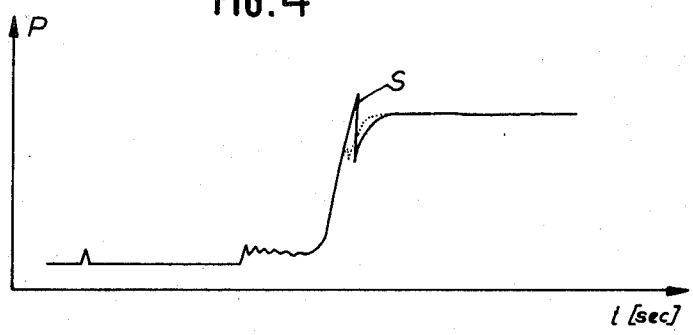
FIG. 4 shows the pressure course in the pressure die-casting mould during the casting on a three-phase pressure die-casting machine.
Figure 5:
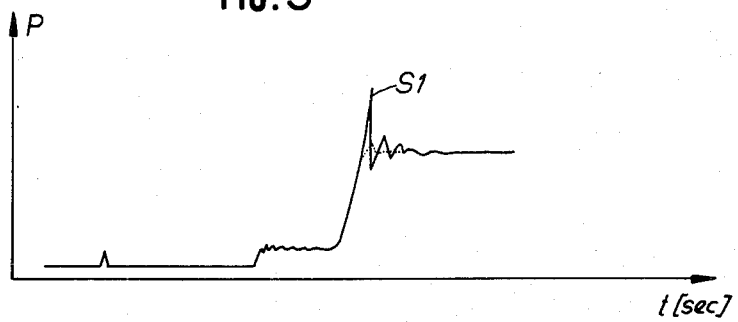
FIG. 5 shows the pressure course in the die-casting mould during the casting on a two-phase pressure die-casting machine.

Shown in FIGS. 4 and 5 with solid lines is the pressure course in the case of a previous three-phase pressure die-casting machine or a two-phase pressure die-casting machine, in which respect the pressure peaks are designated by S or by S1 respectively. The dotted lines in FIGS. 3 and 4, on the other hand, show the pressure course upon the use of a pressing-in part in accordance with the invention, in which the outflow of the pressure medium from annular chamber 31 of working cylinder 1 is controlled as above described.

The FIG. 2 embodiment differs from the FIG. 1 embodiment in that a controllable check valve 39 is installed in line 7 between prestressing chamber 6 and bubble store 8. With the aid of check valve 39, prestressing chamber 6 can be shut off, so that pressure chamber 33 of multiplier cylinder 4 can be connected already at the start of the second phase, by way of volume control device 25 to piston store 18. In this way, multiplier piston 5 is acted upon with pressure medium already at the start of the second working phase. On account of the shut-off of prestressing chamber 6 by check valve 43, multiplier piston 5, however, still cannot move. If then at the end of the second working phase, check valve 43 is unblocked by way of a way-valve 44 which is actuatable in time-dependent, pressure-dependent or path-dependent manner, the pressure medium can escape from prestressing chamber 6, so that multiplier piston 5 is set in motion in delay-free manner.

The charging pressure in bubble store 8 and prestressing chamber 8 and thus the desired final pressure of the multiplication is in turn adjusted by pressure control device 23 in the above-described manner.

FIG. 3 shows additionally a special arrangement of working cylinder, multiplier cylinder and check valve, in which the remaining component parts of the pressing-in part correspond with the embodiments in accordance with FIGS. 1 and 2 wherefore they have been omitted.

In contrast to the embodiments shown in FIGS. 1 and 2 and in which working cylinder 1 and multiplier cylinder 4 are arranged coaxially to one another, the axes of working cylinder 1 and multiplier piston 4 in this instance are arranged perpendicularly to one another. Check valve 10 is arranged in that wall of working cylinder 1 which extends perpendicularly to the axis of working cylinder 1 and which defines working chamber 11 between working piston 2 and multiplier piston 5. The advantage is that the check valve is directly exposed to the pressure of the pressure medium in the working chamber but nevertheless is easily accessible for maintenance and repair work.

I claim:

1. A pressure die-casting machine comprising: a working cylinder, a working piston displaceable in the working cylinder, a multiplier cylinder connected to the working cylinder, a multiplier piston displaceable in the multiplier cylinder, a working chamber disposed between the working and multiplier pistons, a pressure medium supply line connected to the working chamber for driving the working piston during each of a first and a second working phase, a first pressure source and means for connecting said first pressure source to said supply line in said first working phase, a second pressure source and first valve means for controlling the pressure medium from said second pressure source and connecting said second pressure source to said medium supply line during said second phase; a check valve disposed in the pressure medium supply line, a pressure chamber on the side of the multiplier piston remote from the working chamber for receiving a pressure medium capable of driving the multiplier piston during a third working phase, a second valve means for controlling the pressure medium from said second pressure source and connecting said second pressure source to said pressure chamber during said third phase, the pressure medium supply line extending outside the multiplier piston, the check valve being arranged on a wall portion close to the working chamber of the working cylinder, the supply of the pressure medium to the pressure chamber of the multiplier cylinder being actuatable independently of the check valve.

2. In the die-casting machine as claimed in claim 1, wherein said second valve means comprises a preselectable volume control device having a passage for the pressure medium, and a control valve for controlling the volume control device and being actuatable in a pressure-dependent or time-dependent or path-dependent manner.

3. A pressure die-casting machine as set forth in claim 1, a prestressing chamber in the multiplier cylinder disposed on the side of the multiplier piston which is remote from the pressure chamber, the prestressing chamber being connected to a pressure store by way of a line, the charging pressure in the pressure store (8) and the prestressing chamber (6) being adjustable by way of a pressure control device (23).

4. A pressure die-casting machine as set forth in claim 3, including: a controllable second check valve (43) arranged in the line (7) between the prestressing chamber (6) and pressure store (8).

5. A pressure die-casting machine as set forth in claim 4, including: a valve (44) for controlling the second check valve (43) which, as a function of its position, connects the prestressing chamber (6) either to an atmosphere-loaded tank or to the pressure store (8) associated with the prestressing chamber (6).

6. A pressure die-casting machine as set forth in claim 5, characterized in that: the valve (44) being actuatable without a time delay as a function of a control pulse, which also causes the switching-on of the second working phase.

7. A pressure die-casting machine as set forth in claim 1, characterized in that: an annular chamber (31), lying on that side of the working piston (2) which is remote from the working chamber (11), of the working cylinder (1) is connected, in the region of its end face remote from the working piston (2), by way of a volume control device (40) to an atmosphere-loaded tank (41).

8. A pressure die-casting machine as set forth in claim 7, characterized in that: the volume control device (40) is adjustable digitally.

9. A pressure die-casting machine as set forth in claim 1, characterized in that: that side of the multiplier piston (5) which is remote from the working chamber (11) is acted upon by a spring-loaded sensing pin (26), the other end of which actuates a limit switch (27) which serves to indicate the position of the multiplier piston (5).

10. A pressure die-casting machine as set forth in claim 1, characterized in that: a pressure absorber (28) is arranged in the path of the pressure medium between the working piston (2) and the check valve (10).

* * * * *